US007545944B2

(12) United States Patent
Allegro Baumann et al.

(10) Patent No.: US 7,545,944 B2
(45) Date of Patent: Jun. 9, 2009

(54) CONTROLLING A GAIN SETTING IN A HEARING INSTRUMENT

(75) Inventors: Silvia Allegro Baumann, Unterageri (CH); Stefan Launer, Zurich (CH)

(73) Assignee: Phonak AG, Stafa (CH)

( * ) Notice: Subject to any disclaimer, the term of this patent is extended or adjusted under 35 U.S.C. 154(b) by 488 days.

(21) Appl. No.: 11/108,570

(22) Filed: Apr. 18, 2005

(65) Prior Publication Data

US 2006/0233385 A1 Oct. 19, 2006

(51) Int. Cl.
*H04R 5/00* (2006.01)
*H04R 25/00* (2006.01)
*H04R 29/00* (2006.01)

(52) U.S. Cl. ..... 381/23.1; 381/60; 381/315; 381/321

(58) Field of Classification Search ..... 381/23.1, 381/321, 60, 315
See application file for complete search history.

(56) References Cited

U.S. PATENT DOCUMENTS

| | | | | |
|---|---|---|---|---|
| 6,415,185 | B1 * | 7/2002 | Maltan | 607/57 |
| 7,171,272 | B2 * | 1/2007 | Blamey et al. | 607/57 |
| 2004/0190734 | A1 * | 9/2004 | Kates | 381/106 |
| 2006/0227976 | A1 * | 10/2006 | Csermak et al. | 381/1 |

FOREIGN PATENT DOCUMENTS

| | | |
|---|---|---|
| EP | 0 941 014 | 9/1999 |
| EP | 1 379 102 A2 | 1/2004 |
| EP | 1 465 454 | 10/2004 |
| WO | 2004/110099 | 12/2004 |
| WO | 2004/114722 | 12/2004 |

OTHER PUBLICATIONS

Kochkin, Sergei and Kuk, Francis. Binaural Hearing Aids: "The Fitting of Choice forBilateral Loss Subjects." Published on: http://www.spanish.medical.hear-it.org/multimedia/BINAURALTUT.pdf.
Zwicker. E. and Fastl, H. "Psychacoustics: Facts and Models." Springer, Berlin, 2nd Ed., 1999, pp. 311-313.
Thomas A. Powers and Pamela Burton: "Wireless technology designed to provide true binaural amplification", The Hearing Journal, vol. 58, No. 1, Jan. 1, 2005, XP002345661.

* cited by examiner

*Primary Examiner*—Curtis Kuntz
*Assistant Examiner*—Jesse A Elbin
(74) *Attorney, Agent, or Firm*—Pearne & Gordon LLP

(57) ABSTRACT

According to the invention, in a hearing instrument it is once or repeatedly checked whether a second hearing instrument is present and active. If a second hearing instrument is active on the contralateral side, a first gain (corresponding to the gain for binaural fitting) is applied. If, however, no further hearing instrument is found to be active, a second—increased—gain is applied. The second gain may simply correspond to the first gain increased by a certain dB value. It may as an alternative be a specifically adapted gain characteristic of a monaural fitting for the user.

13 Claims, 2 Drawing Sheets

CONTROLLING A GAIN SETTING IN A HEARING INSTRUMENT

FIELD OF THE INVENTION

This invention is in the field of processing signals in or for hearing instruments. It more particularly relates to a method of controlling a gain setting in a hearing instrument, and to a hearing instrument.

BACKGROUND OF THE INVENTION

Binaural loudness summation is known in the field of audiology. Binaural loudness summation is the effect that the loudness of sound is greater when it is presented to both ears simultaneously than when it is presented to one ear alone. The magnitude of this effect varies between individuals. Usually, the increase in loudness is approximately 3 dB when the intensity level is near the person's hearing threshold. The effect increases at suprathreshold level.

Binaural loudness summation is one of the advantages of binaural amplification. For persons with bilateral hearing loss who are equipped with two hearing instruments, the applied gain may be reduced. Due to the reduced gain, the chance of feedback is decreased, and larger vents may be used.

Since the optimal gain is different between monaural and binaural fittings, the loss of binaural loudness summation accounts for a non-ideal gain fitting if a user, who usually wears two hearing instruments, occasionally only uses one hearing instrument. This may happen if the user deliberately only wears one hearing instrument or if one of the hearing instruments is not available.

SUMMARY OF THE INVENTION

It is an object of this invention to provide a method of controlling a gain in a hearing instrument which allows to provide optimal gain characteristics in both, situations when the user wears two hearing instruments and situations when the user only wears one hearing instrument.

According to a first aspect of the invention, in a hearing instrument being operable to determine an output audio signal from at least one input signal and to supply said output audio signal to one ear of a user, the hearing instrument comprising a communication interface operable to establish a communication link to a further hearing instrument, a method of controlling a gain setting of a hearing instrument comprises the steps of determining, using the communication interface, whether a further hearing instrument for the other ear of the user is active, of adopting a first gain setting if a further hearing instrument for the other ear of the user is active, and of adopting a second gain setting different from the first gain setting if no further hearing instrument is active.

Preferably, therefore, it is once or repeatedly checked whether a second hearing instrument is present and active. If a second hearing instrument is active on the contralateral side, a first gain setting is adopted. If, however, no further hearing instrument is found to be active, a second gain setting is chosen. The gain generated by the hearing instrument with the first gain setting may correspond to the gain for binaural fitting, whereas the gain of the second gain setting is increased in comparison. The second gain may simply correspond to the first gain increased by a certain dB value. It may as an alternative be a specifically adapted gain characteristic of a monaural fitting for the user.

According to a second aspect, in a hearing instrument system comprising a first and a second hearing instrument, the first and the second hearing instrument adapted to supply, upon incidence of an input signal, a first and a second output audio signal to a first and a second ear of a user, respectively, a method of setting hearing instrument parameters, the method comprises the steps of, by at least one of said first and said second hearing instruments, polling a status information from the other one of said first and second hearing instruments, and of setting, by said one hearing instrument, a hearing instrument parameter depending on the status of said other hearing instrument.

According to a third aspect, in a hearing instrument system comprising a first and a second hearing instrument, the first and the second hearing instrument adapted to supply, upon incidence of an input signal, a first and a second output audio signal to a first and a second ear of a user, respectively, a method of setting a hearing instrument parameter, the method comprises the steps of proactively sending, by at least one of said first and second hearing instruments, repeatedly and/or in case of imminent instrument failure, a status signal to the other one of said first and second hearing instruments, and of setting, by said other hearing a hearing instrument parameter depending on the status signal received.

In the second and third aspect, the hearing instrument parameter may be a gain setting, wherein a first gain setting is adopted if the other hearing instrument is found to be in a normal operational state, and a second gain setting different from the first gain setting is adopted if said other hearing instrument is found not to be in the normal operational state. As an alternative or in addition thereto, a set parameter may include a status parameter of a signaling unit operable to display or have resound a system status to a user.

The invention also concerns a hearing instrument comprising a signal processing unit operable to generate an output signal from at least one input signal and an electric-to-acoustic converter, an input of which is operatively connected to an output of the signal processing unit and which is operable to supply an acoustic output signal to one ear of a user, the hearing instrument further comprising a communication interface operable to exchange information with a further hearing instrument, the hearing instrument being programmed so as to be operable to detect, using the communication interface, whether a further hearing instrument associated with the other ear of the user is active, and to apply a first gain to the input signal if a further hearing instrument is found to be active, or to apply a second gain to the input signal if no further hearing instrument is found to be active.

"Gain" is usually defined as the ratio between an input signal and an output signal. This ratio may be time-dependent and/or may be frequency dependent. In addition, the gain may be situation dependent (i.e. different gain settings for different hearing programs, which are associated to different acoustic situations).

In a preferred embodiment of the invention, there exists some wireless or wired communication channel between the hearing instruments, across which there is a continuous or repeated communication between the hearing instruments.

A wireless communication channel may be a radio signal transmission or an inductive signal transmission (i.e., using magnetically coupled coils as antennas) or any other suitable wireless communication channel. The signal used may be any signal transmitting any information. In a most simple example, the signal may just be a characteristic regularly repeated presence signal (e.g. a radio frequency carrier signal).

A wired communication channel may for example comprise a physical wire or may comprise the frame of a user's glasses.

Since the only information that has to be transmitted is whether or not a second hearing instrument is active, the communication channel does not have to have a large bandwidth. Compared to prior art communication channels between two hearing instruments, the communication channel may therefore consume comparatively little power.

One of the often encountered reasons for a situation where only one hearing instrument of a binaural system is available is if the battery is empty. For this case, the remaining hearing instrument may, according to a special embodiment of the invention, initiate a signal informing the user of the battery failure of the unavailable hearing instrument and reminding the user to replace the battery of said hearing instrument. Such a signal may be a beep signal, a voice message (like for example "left hearing aid not available" or "change battery of left hearing aid" etc.), a message displayed on a display unit of a remote control etc. According to the prior art, it was possible to produce a warning signal when the battery in a hearing instrument was not yet empty but found to be low. However, it is a well-known fact that the battery charge level in a hearing aid is a quantity that is difficult to measure, at least without extra hardware, so that the "battery-low" warning signals are often unreliable.

A warning signal of this kind is, of course, not produced upon every check but for example only once when the other hearing instrument is found to be unavailable for the first time. The occurrence of such a signal may but does not have to depend on a manually set switch value. For example, the user may switch to a monaural mode in which he deliberately uses one hearing instrument only, in which case a signal will not be output.

The term "hearing instrument" or "hearing device", as understood here, denotes on the one hand hearing aid devices that are therapeutic devices improving the hearing ability of individuals, primarily according to diagnostic results. Such hearing aid devices may be Behind-The-Ear hearing aid devices or In-The-Ear hearing aid devices (including the so called In-The-Canal and Completely-In-The-Canal hearing aid devices, as well as partially and fully implanted hearing aid devices). On the other hand, the term stands for devices which may improve the hearing of individuals with normal hearing e.g. in specific acoustical situations as in a very noisy environment or in concert halls, or which may even be used in the context of remote communication or of audio listening, for instance as provided by headphones.

The hearing devices addressed by the present invention are so-called active hearing devices which comprise at the input side at least one acoustical to electrical converter, such as a microphone, at the output side at least one electrical to acoustical converter, such as a loudspeaker (often also termed "receiver"), and which further comprise a signal processing unit for processing signals according to the output signals of the acoustical to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both.

BRIEF DESCRIPTION OF THE DRAWINGS

In the following, embodiments of the invention are described with reference to drawings. The drawings are all schematical and show.

DESCRIPTION OF THE PREFERRED EMBODIMENTS

Figure 1:
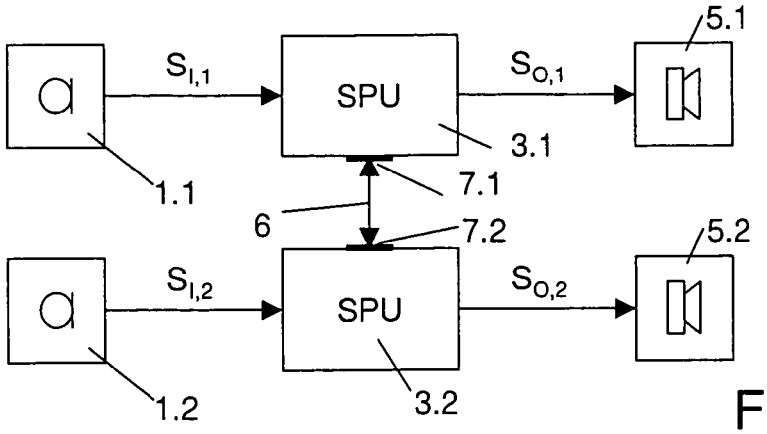
FIG. 1 a binaural hearing instrument system comprising two hearing instruments, FIG. 2 a diagram of a first embodiment of the method according to the invention, FIG. 3 an illustration of a gain increase in accordance with the first embodiment, FIG. 4 a diagram of a second embodiment of the method according to the invention, FIG. 5 an illustration of a gain increase in accordance with the second embodiment.

The hearing instrument system of FIG. 1 comprises a set of two hearing instruments, each including at least one acoustic-to-electric converter 1.1, 1.2 (often, two or even three acoustic-to-electric converters are available in each hearing instrument), a signal processing unit (SPU) 3.1, 3.2 operable to apply a time- and/or frequency-dependent gain to the input signal or input signals $S_{I,1}$, $S_{I,2}$ resulting in output signal $S_{O,1}$, $S_{O,2}$ and at least one electric-to-acoustic converter 5.1, 5.2. Between the two hearing instruments—in the shown embodiment between the signal processing units—there is a communication channel 6 by which the hearing instruments may exchange information. The communication interfaces of the hearing instruments are denoted by 7.1 and 7.2.

Figure 2:
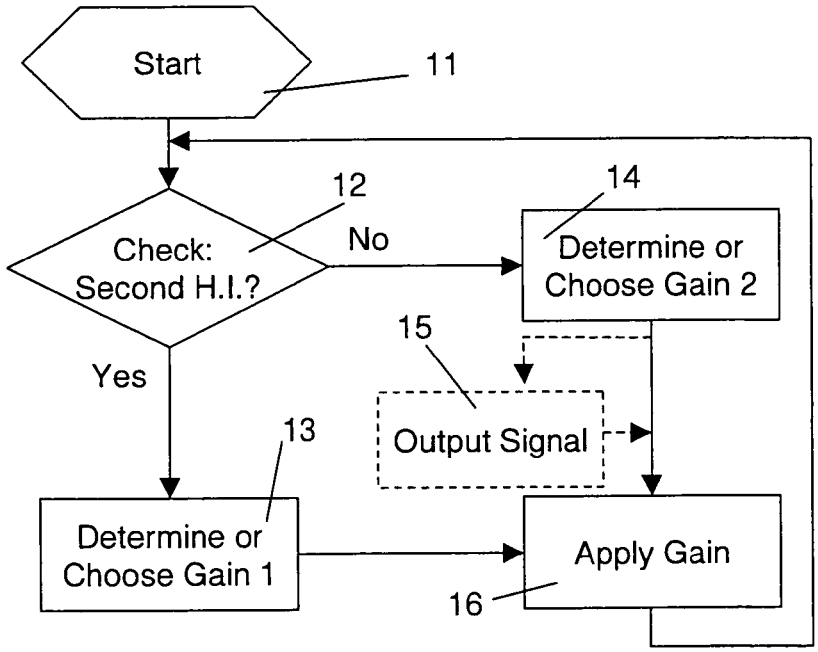

An embodiment of the method according to the invention—as implemented in at least one, preferably in both of the hearing instruments—is illustrated in FIG. 2. After initiation 11, a check 12 is carried out by the hearing instrument via the communication channel. By the check it is determined whether the second hearing instrument is active. For example, it is checked whether a characteristic signal is received by a coil serving as antenna. The overall gain setting—which may in addition depend on other parameters such as stored, pre-set user specific values, detected noise, incoming sound direction, a loudness level or an amplification level pre-set by the user etc.—applied to the input signal is chosen dependent on the result of this check (gain application 16). A first gain setting 13 is applied in the case both hearing instruments are functional. The first gain setting is adapted to binaural hearing and accounts for the phenomenon of binaural loudness summation. In case one of the hearing instruments is not functional, a second gain setting 14 is applied. The second gain setting may be qualitatively different from the first gain setting and may be based on different parameters (for example on different noise suppression algorithms, on different time constants, etc.). It may as an alternative be calculated from the first gain setting in an appropriate way, for example by adding a loudness and frequency dependent value to the gain.

Figure 3:
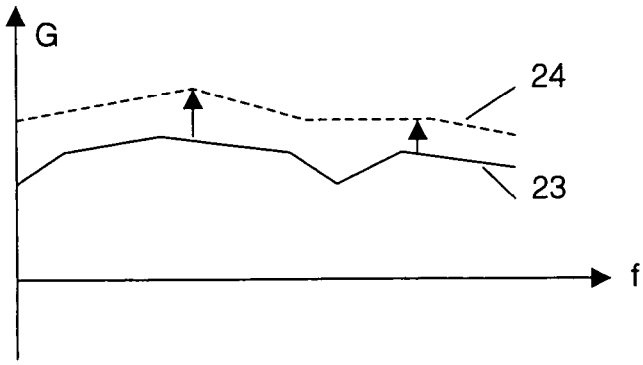

The second gain (corresponding to the second gain setting) is higher compared to the first gain. In case the gain is frequency dependent, this means that an average of the gain the audible part of the sound spectrum is higher. The second gain may be specifically adapted to monaural hearing and to the characteristic hearing ability of the ear to which the remaining hearing instrument is associated. In other words, the second gain and possibly also the first gain need not be identical for both hearing instruments of a hearing instrument system. An example of a gain increase in case of a frequency dependent gain is illustrated very schematically in FIG. 3. A first gain curve 23 depicts the frequency dependence of the first gain, whereas a second gain curve 24 shows the frequency dependence of the second gain. The second gain does not have to be higher than the first gain for all frequencies, although preferably in the part of the frequency spectrum which is most important for speech perception for the user, the second gain is on average higher than the first gain.

The step of checking whether both hearing instruments are functional is preferably repeated regularly. Also, the step of determining whether a further hearing instrument is active can be carried out repeatedly at regular or random time intervals.

Once the temporarily unavailable hearing instrument becomes available again—for example since the battery has been replaced or since the instrument is functional again—this will be detected, and the gain re-set to "binaural" (i.e. to the first gain setting).

As an alternative to the repeated checking of the status of the other hearing instrument ("polling") a further possibility exists. According to an alternative, a status information of a hearing instrument is transmitted to the other hearing instrument proactively, at regular intervals or on special occasions, such as in case of imminent failure (for example before the battery is empty). Once such a proactively sent status information is received, a status information tag (or the like) in a memory of the receiving hearing instrument may be set to "not active" (referring to the other hearing instrument). The step of determining whether the other hearing instrument is active then includes internally checking the status information tag. The status information tag is re-set to "active"—for example manually or by a status information transmission by the other hearing instrument when it is switched on—when the other hearing instrument is activated again.

The hearing instrument may optionally once or repeatedly produce a signal 15 when the check reveals that the other hearing instrument is not active. The signal may for example be acoustical or may be a warning message displayed on a display field of a remote control (not shown). By the signal, the user may for example be reminded by the still functioning hearing aid to replace the battery of the other hearing instrument.

If the signal is acoustical, preferably the hearing instrument may manually be set to a mode where the signal does not appear so that the user is not disturbed by the signal in situations where he deliberately only uses only one hearing instrument.

Figure 4:
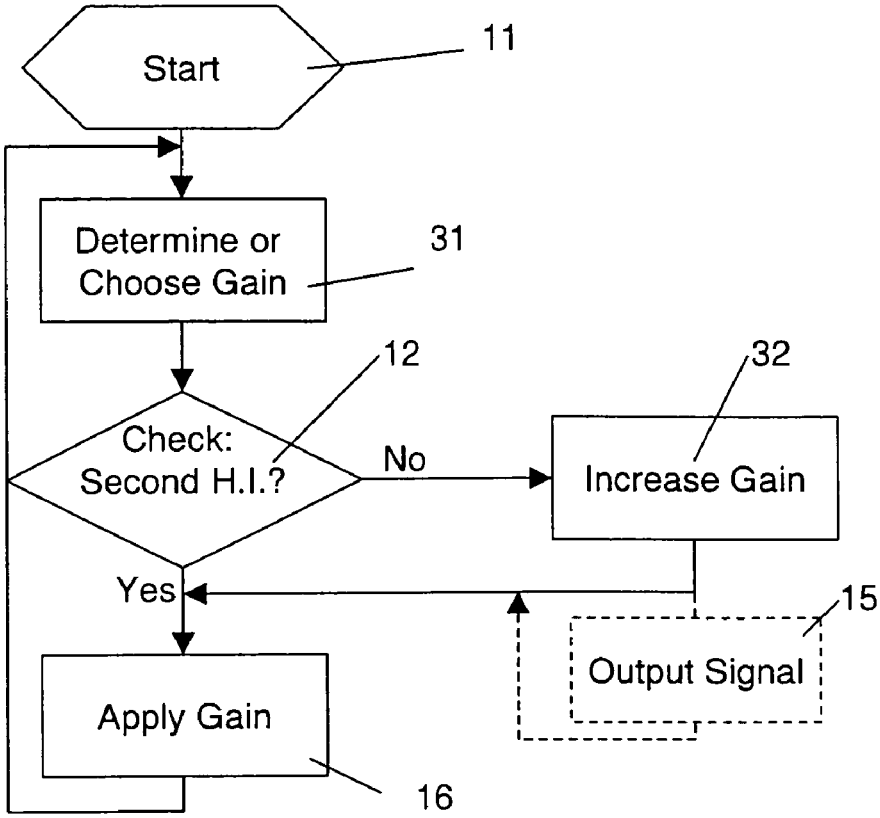
Figure 5:
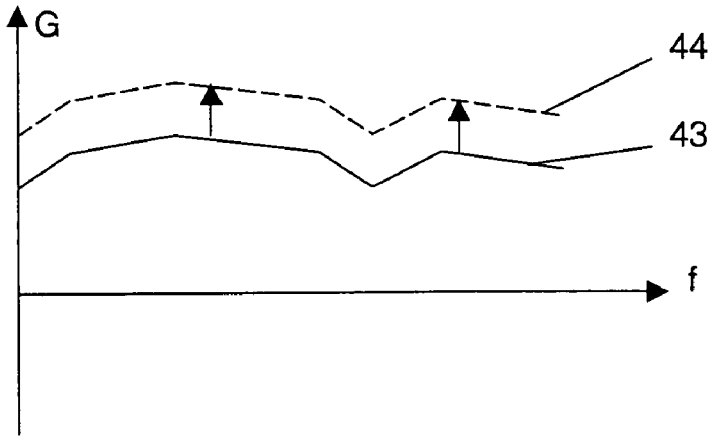

A second embodiment of the method according to the invention is shown in FIG. 4. The embodiment of FIG. 4 may be viewed as special, particularly simple variant of the embodiment of FIG. 2. As in said previous embodiment, after initiation 11, a check 12 is carried out by the hearing instrument via the communication channel. A gain setting determination 31—the gain may again depend on parameters such as be fixedly stored, for example user-characteristic values, detected noise, incoming sound direction a loudness level or amplification level pre-set by the user etc.—is carried out before or after or simultaneously to the check. If the check reveals that the other hearing instrument is not active, the gain is increased 32 in a pre-determined manner. It may for example be increased by adding a fixed dB value (for example between 2 dB and 5 dB) for all frequencies. This is illustrated in FIG. 5, where the second gain curve 44 corresponds to the first gain curve plus a fixed value which is constant for all frequencies. As an alternative, a fixed value which depends on the frequency may be added.

The embodiment of FIG. 4 features the advantage that it is relatively simple. Also the embodiment of FIG. 4 may comprise providing a signal 15 when it has been found that the other hearing instrument is not active.

A process of the kind shown in FIGS. 2 and 4 may be carried out in both hearing instruments. If one hearing instrument fails, the other one will switch to the second gain (or the increased gain).

A hearing instrument according to the invention comprises means for carrying out any embodiment of the above described method. A hearing instrument system comprises two hearing instruments, shaped and adapted to be placed behind or in the left and right ear of the user, respectively. In the case of wireless communication, the communication interfaces of the two hearing instruments are for example adjusted to each other so that only signals of the corresponding hearing instruments of the hearing instrument system may be detected or that signals of hearing instruments of other hearing instrument systems—for example of hearing instruments worn by other persons nearby—may be distinguished. As an alternative, universal interfaces may be used, so that upon replacement of one hearing instrument no adaptation has to be done.

Various other embodiments may be envisaged without departing from the scope and spirit of the invention.

What is claimed is:

1. A method of controlling a gain setting of a hearing instrument, comprising the steps of:

providing the hearing instrument, said hearing instrument being operable to determine an output audio signal from at least one input signal and to supply said output audio signal to one ear of a user, the hearing instrument comprising a communication interface operable to establish a communication link to a further hearing instrument;

determining, using the communication interface, a status information, the status information being whether a further hearing instrument for the other ear of the user is active; and using the status information for setting a gain of the hearing instrument by:

adopting, based on the status information, a first gain setting if a further hearing instrument for the other ear of the user is active; and adopting, based on the status information, a second gain setting different from the first gain setting if no further hearing instrument is active.

2. A method according to claim 1, wherein an average gain value of the first gain setting is lower than an average gain value of the second gain.

3. A method according to claim 2, wherein the gain in accordance with the second gain setting corresponds to the gain in accordance with the first gain setting increased by a fixed dB value which may be frequency dependent or frequency independent.

4. A method according to claim 1, wherein the step of determining whether a further hearing instrument is active is carried out repeatedly at regular or random time intervals.

5. A method according to claim 4 wherein, for determining whether a further hearing instrument for the other ear of the user is active, the hearing instrument sends a request signal demanding a status information from the potential further hearing instrument.

6. A method according to claim 1, wherein, in case a further hearing instrument is active, a status information is sent to the hearing instrument proactively.

7. A method according to claim 1, wherein at least one signal perceivable by the user is initiated by the still active hearing aid when no further hearing instrument is active.

8. A method of setting a hearing instrument parameter in a hearing instrument system, comprising the steps of:

providing a first and a second hearing instrument, the first and the second hearing instrument adapted to supply, upon incidence of an input signal, a first and a second output audio signal to a first and a second ear of a user, respectively;

by the first hearing instrument, polling a status information from the second hearing instrument, the status information being whether the second hearing instrument is active;

as a response to the polling by the first hearing instrument, sending the status information from the second hearing instrument to the first hearing instrument; and using the status information for setting a gain of the first hearing instrument by setting, by the first hearing instrument, a hearing instrument gain setting depending on the status information from the second hearing instrument.

9. The method according to claim 8, wherein the step of setting a hearing instrument gain comprises adopting a first gain setting if said second hearing instrument is found to be in a normal operational state, and of adopting a second gain setting different from the first gain setting if said second hearing instrument is found not to be in the normal operational state.

10. A method of setting a hearing instrument parameter, comprising the steps of:

providing a hearing instrument system comprising a first and a second hearing instrument, the first and the second hearing instrument adapted to supply, upon incidence of an input signal, a first and a second output audio signal to a first and a second ear of a user, respectively;

proactively sending, by at least one of said first and second hearing instruments, at least one of repeatedly and of in case of imminent instrument failure, a status signal to the other one of said first and second hearing instruments, the status signal being whether the at least one of said first and second hearing instruments is active or in the case of imminent failure; and using the status signal for setting a gain of said other hearing instrument by setting, by said other hearing instrument, a hearing instrument gain depending on the status signal received.

11. The method according to claim 10, wherein the step of setting a hearing instrument gain comprises adopting a first gain setting if said one hearing instrument is found to be in a normal operational state, and of adopting a second gain setting different from the first gain setting said one hearing instrument is found not to be in the normal operational state.

12. A hearing instrument comprising a signal processing unit operable to generate an output signal from at least one input signal and an electric-to-acoustic converter, an input of which is operatively connected to an output of the signal processing unit and which is operable to supply an acoustic output signal to one ear of a user, the hearing instrument further comprising a communication interface operable to exchange information with a further hearing instrument, the hearing instrument being programmed so as to be operable to detect, using the communication interface, a status information indicative of whether a further hearing instrument associated with the other ear of the user is active, and to use the status information for setting a gain by applying a first gain to the input signal if a further hearing instrument is found to be active, and by applying a second gain to the input signal if no further hearing instrument is found to be active.

13. The hearing instrument according to claim 12, wherein the communication interface is a wireless communication interface.

* * * * *